US005519976A

United States Patent [19]

Gee

[11] Patent Number: 5,519,976

[45] Date of Patent: May 28, 1996

[54] LEVELLING CLIP FOR SUSPENDED CEILING SYSTEMS

[75] Inventor: Graeme Gee, Oakville, Canada

[73] Assignee: CGC Interiors A Division of CGC, Inc., Oakville, Canada

[21] Appl. No.: 314,232

[22] Filed: Sep. 28, 1994

[51] Int. Cl.[6] ..... E04C 2/08

[52] U.S. Cl. ..... 52/712; 52/715; 24/67.9; 24/67 AR

[58] Field of Search ..... 24/115 M, 115 H, 24/67.9, 67 AR; 52/712, 715

[56] References Cited

U.S. PATENT DOCUMENTS

| | | | |
|---|---|---|---|
| 344,408 | 6/1886 | Scarles | 52/715 X |
| 2,846,134 | 8/1958 | Moubayed | 24/67 AR |
| 3,359,701 | 12/1967 | Schneller | 52/712 |
| 3,608,263 | 9/1971 | Gartner | 52/712 X |
| 3,798,865 | 3/1974 | Curtis | 52/715 X |
| 3,910,001 | 10/1975 | Jackson | 52/712 X |
| 4,120,122 | 10/1978 | Bahr | 52/715 X |
| 4,656,794 | 4/1987 | Thevenin et al. | 52/715 X |
| 4,831,808 | 5/1989 | Wynar | 52/715 |
| 4,998,397 | 3/1991 | Orton | 52/715 |
| 5,398,384 | 3/1995 | Rinard | 24/67.9 |

*Primary Examiner*—Wynn E. Wood
*Attorney, Agent, or Firm*—Volpe and Koenig

[57] ABSTRACT

The present invention comprises a levelling clip for use during the installation of suspended ceiling systems. The levelling clip includes a base portion, rear retention means and front retention means for attaching the clip in sliding engagement to the wall angle moulding. The clip of the present invention provides a faster and easier means of installing a suspended ceiling system including levelling and squaring the pattern of main grid members and cross members of a suspended ceiling system.

4 Claims, 1 Drawing Sheet

LEVELLING CLIP FOR SUSPENDED CEILING SYSTEMS

BACKGROUND OF THE INVENTION

1. Field of the invention

The present invention relates to an improved method and apparatus for levelling suspended ceiling grid systems.

2. Description of the Prior Art

Suspended ceiling systems are well known and are the most common ceiling system used in office complexes and residential basement renovations. The suspended ceiling grid system comprises wall angle mouldings, main grid members (main tees) running in one direction of the ceiling with cross members (cross tees) connected to adjacent main grid members to form the grid pattern. The most common grid patterns are rectilinear or square grids although a non-rectilinear pattern can be used if desired.

In installing a suspended ceiling system the first step after doing a layout is the installation of the wall angle moulding. Typically a mark is made at the height desired for the new ceiling. The height of the wall angle moulding is added and by using a carpenter's level a level line is marked around three walls. A chalk line can be used to mark the fourth wall. The wall angle moulding is then fastened to the wall with the top edge of the moulding placed on the level line. Making sure the wall angle moulding is at the same height and level around the room is an important first step in installing the ceiling properly.

The main grid members or tees are suspended from the floor above by wire or plastic fasteners. With reference to the layout, the distance from one wall for the border panels is measured. Using that distance and a chalk line the location of the first main tee is marked on the floor joists. Chalk lines are then made parallel to the first chalk line the length of a panel (typically four feet). Wire or plastic fasteners are then nailed or screwed into the floor joists (or floor) approximately every four feet along the chalk lines. Hanger wires are then securely attached to the fasteners.

Very seldom is a room perfectly square. So from any corner of the room, two reference strings are stretched along both walls at the distance calculated for the border panels. The strings are attached to the bottom of the wall angle moulding by nails, pins or tape and aligned so they intersect at a 90° angle. This will insure that the grid pattern is square. One string will be the guide for the first main tee and the other string for the first row of cross tees.

The first main tee is trimmed so that a cross tee slot lines up with the cross tee guide string when the trimmed end is set on the end wall moulding. The trimmed main tee may then be placed on the side wall moulding with the trimmed end against the end wall. A mark is made on the side wall through the wire support hole in the main tee that is farthest from the end wall but closest to a hanger wire. The process is repeated on the opposite wall. A tight string line is stretched across the room from mark to mark. The hanger wires are bent at 90° where they touch the string. Additional strings are utilized at eight to ten foot intervals and hanger wires bent so that the ceiling will be level across the room.

The first main tee is installed at the guide string with the trimmed end on the end wall moulding and the other end supported by one of the pre-bent hanger wires. To span the length of the room main tees are connected until the last main tee needs trimming to fit on the opposite end wall moulding. The main tees are supported every eight to ten feet using the pre-bent hanger wires. The remaining hanging wires are inserted into the support holes in the main tee. Using a level the wires are adjusted to ensure the main tee is level. The process is repeated for each row of main tees.

Starting at the guide string the cross tees are installed between main tees and for some grid systems (2'×2') between cross tees. The middle ceiling panels are inserted into place to square up the grid. The main tee is then realigned with the guide string as the grid structure with panels inserted will slide along the wall angle moulding. The cross tees between the main tees and wall angle moulding are then measured, trimmed and installed starting at the guide string, doing first a cross tee on one side then the opposite side of the room alternately until all cross tees are in place.

The ceiling panels are then installed starting first with the middle panels and then the panels around the border of the room that must be measured and cut to fit the openings.

SUMMARY OF THE INVENTION

An object of the present invention is to provide a simple means of levelling the grid of a suspended ceiling system.

An other object of the present invention is to provide a simple means of squaring the pattern of main grid members and cross members of a suspended ceiling system.

An other object of the present invention is to provide faster and easier means of installing a suspended ceiling system including levelling and squaring the pattern of main grid members and cross members of a suspended ceiling system.

Accordingly the present invention comprises a levelling clip for use during the installation of suspended ceiling systems. The levelling clip includes a base portion, rear retention means and front retention means for attaching in sliding engagement the clip to the wall angle moulding.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
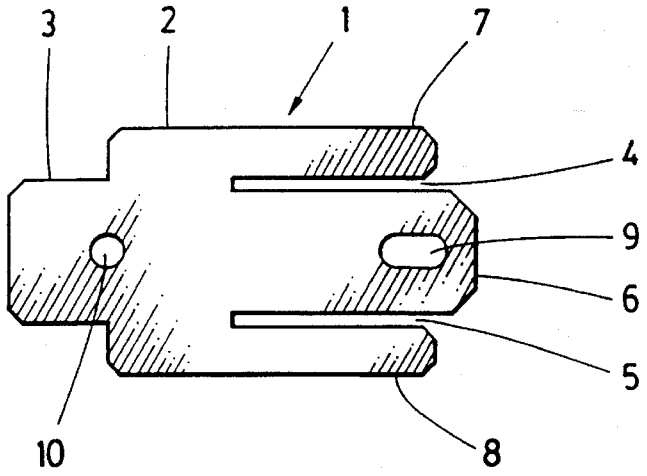
FIG. 1 is a top view of a levelling clip according to the present invention.
Figure 2:
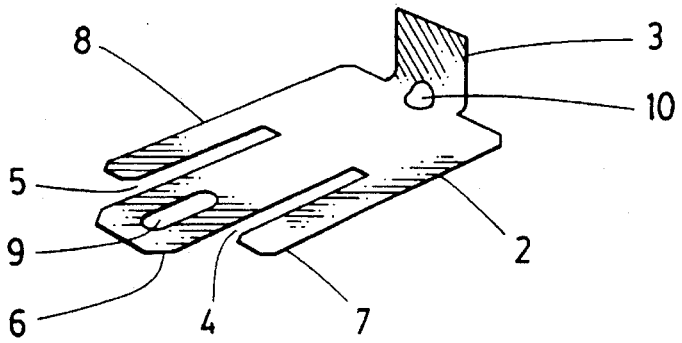
FIG. 2 is a top view of the clip of FIG. 1 with the rear tab bent for retention between the wall and the wall angle moulding.
Figure 3:
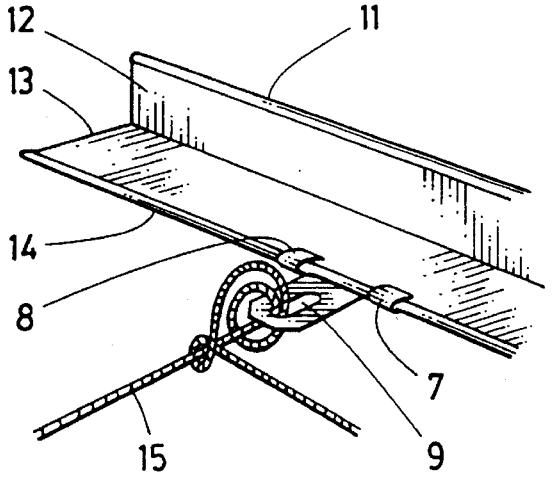
FIG. 3 shows the clip of FIG. 1 attached to the wall angle moulding.

Referring to FIGS. 1–3, the levelling clip according to the present invention is generally indicated at 1. The levelling clip 1 consists of a base portion 2 generally having a rectangular shape and a rear retention means consisting in the preferred embodiment of tab 3. In order to connect the clip to the wall angle moulding, the clip also includes front retention means which in the preferred embodiment consist of a pair of parallel longitudinal slots 4,5 located in the front of the base portion 2 forming side tabs 7,8 in the front section 6 of base portion 2. The side tabs 7,8 can be bent over the front edge of the wall angle moulding. An aperture 9 is provided in front section 6.

As shown in FIG. 2, rear tab 3 is intended to be bent at right angles to base portion 2 when the clip is in use. The clip is preferably made from a flat piece of thin gauge metal sheeting that provides sufficient rigidity and strength to operate as intended and yet permit the rear tab to be easily bent without the need for any special tools. To make it easier to bend the tab 3, a small hole 10 is provide with its center along the point of connection between the rear tab and the base portion.

The gauge of the material from which the clip is made must be thin enough to permit the rear tab to fit between the vertical flange 12 of well angle moulding 11 and the wall (not shown) without damaging the moulding or wall.

The side tabs 7,8 and slots 4,5 are sized so that when the rear tab 3 is bent and placed between the vertical flange 12 of wall angle moulding 11 end the wall, the side tabs can be folded over the edge 14 of horizontal flange 13 of the wall angle moulding to attach the clip to the moulding. The side tabs will secure the clip to the moulding so that it doesn't fall off but will permit the clip to slide along the moulding. So that the clip will slide without hitting any obstructions, such as the nails securing the moulding to the wall, the rear tab is shorter than the height on the wall moulding were it is fastened to the wall.

As shown in FIG. 3, string 15 is connected to the clip through aperture 9. The initial attachment of the clip to the wall angle moulding requires the rear tab to first be bent at 90° to the base of the clip. The tab is then, from below the moulding, inserted between the vertical flange of the moulding and the wall. Side tabs are then bent over the front edge of the moulding to hold the clip in place. The size of the rear tab and side tabs is such that the clip can be easily removed from the wall angle moulding by pulling down on the rear of the clip. The clip can also be re-attached to the wall moulding by putting the side tabs over the front edge of the moulding and pushing the rear tab up between the wall and moulding.

The levelling clip 1 can be used to both square the grid system and level the main tees. The clips are attached to the wall angle mouldings to run string lines across the room perpendicular to the direction of the main tees. With the cut end of the main tee on the end wall moulding the other end of the main tee is lowered until it barely touches the string line. Using the hanger wire or T-bar hanger straps the main tee is secured at this height to insure a level ceiling. The strings can be moved down the room by sliding the clips along the wall angle mouldings eliminating the need to measure mark and set up separate strings down the room.

To square up the main tees and the first row of cross tees the clips of the present invention can be used to run guide strings by sliding the clips along the wall mouldings to the desired location without the need to run separate strings.

The clips of the present invention make it easier and faster to ensure that the suspended ceiling is level and square.

It will be appreciated that the above description related to the preferred embodiment by way of example only. Many variations on the invention will be obvious to those knowledgeable in the field, and such obvious variations are within the scope of the invention as described and claimed, whether or not expressly described.

What is claimed as the invention is:

1. A clip for temporary attachment to wall angle mouldings of suspended ceiling systems for levelling and squaring the ceiling, said clip comprising a flat base portion, rear retention means consisting of a rear tab that can be bent at 90° to the base portion and front retention means including a pair of longitudinal slots in said base portion forming side tabs bendable over the wall angle moulding for attaching said clip in sliding engagement to the wall angle moulding.

2. A clip according to claim 1 wherein an aperture is provided in said base portion to permit a string to be connected to the clip.

3. A clip according to claim 1 wherein a small hole is provided in the rear tab adjacent the base portion.

4. A clip according to claim 1 wherein the clip is made from thin gauge metal sheet.

* * * * *